United States Patent [19]

Hay et al.

[11] 3,993,478

[45] Nov. 23, 1976

[54] PROCESS FOR DISPERSOID STRENGTHENING OF COPPER BY FUSION METALLURGY

[75] Inventors: Donald A. Hay, Medfield; Peter T. Gregg, Shirley, both of Mass.; Walter L. Finlay, New York, N.Y.

[73] Assignee: Copper Range Company, New York, N.Y.

[22] Filed: Feb. 4, 1974

[21] Appl. No.: 439,624

Related U.S. Application Data

[63] Continuation of Ser. No. 225,003, Feb. 9, 1972, abandoned.

[52] U.S. Cl. ..... 75/159; 29/527.7; 75/153; 75/164; 148/32

[51] Int. Cl.[2] ..... C22C 9/00; C22C 9/06

[58] Field of Search ..... 75/.5, 134, 135, 153, 75/159, 164; 148/11.5, 12.7, 13.2, 32; 29/527.7

[56] References Cited

UNITED STATES PATENTS

| | | | |
|---|---|---|---|
| 2,793,949 | 5/1957 | Imich | 75/135 |
| 3,180,727 | 4/1965 | Alexander et al. | 75/134 |
| 3,189,444 | 6/1965 | Old et al. | 75/135 X |
| 3,194,656 | 7/1965 | Vordahl | 75/153 X |
| 3,205,099 | 9/1965 | Vordahl | 148/11.5 |
| 3,208,846 | 9/1965 | Bruma | 75/153 |
| 3,240,592 | 3/1966 | Bray | 75/135 |
| 3,286,334 | 11/1966 | Hay | 29/527.7 |
| 3,468,658 | 9/1969 | Herald et al. | 75/135 X |
| 3,515,542 | 6/1970 | Larsen | 75/135 X |
| 3,574,609 | 4/1971 | Finlay et al. | 148/32 |

*Primary Examiner*—C. Lovell

*Attorney, Agent, or Firm*—Morse, Altman, Oates & Bello

[57] ABSTRACT

In the production of stable dispersoid titanium, carbide strengthened copper by fusion metallurgy, refractory dispersoid particles are formed in situ within the copper melt by reaction between specifically selected components including nickel within the melt. The components are characterized by novel wetting relationships, by which the refractory dispersoid is maintained as such within the melt. The resulting composite material has been found to have an unusual association of high electrical conductivity and high temperature strength, by virtue of which novel electromechanical switches and the like are possible.

6 Claims, 3 Drawing Figures

PROCESS FOR DISPERSOID STRENGTHENING OF COPPER BY FUSION METALLURGY

This is a continuation of application Ser. No. 225,003, filed Feb. 9, 1972, now abandoned.

BACKGROUND OF THE INVENTION

The present invention relates to metallurgy and, more particularly, to the production of metallurgical compositions involving a continuous phase or matrix and a dispersed phase of dispersoid. More particularly, the present invention relates to "stable dispersoid strengthened" composite materials in which a relatively soft copper matrix provides at least one desired characteristic and a relatively hard refractory dispersoid provides at least another desired characteristic. Of all available materials, copper generally offers the best combination of lowest cost and highest electrical conductivity with adequate strength and corrosion resistance. Moreover, its strength can be greatly increased by cold-working with small reduction in electrical conductivity. In practice, cold worked commercially pure copper constitutes the optimum choice for electrical conductors, switches, etc. requiring higher strength than that of annealed copper at room temperature. On the other hand, the strengthening effect of cold-work is gradually lost by heating via atomic phenomena known as "recovery" and "recrystallization." In pure copper, these phenomena occur below the service temperatures and times increasingly desired in modern electrical machinery, i.e. higher hot creep strength is required.

In accordance with known techniques, hot strength can be obtained by solid solution hardening or precipitation hardening. With the former, as a result of there being a high concentration of alloy in the copper matrix, electrical conductivity is drastically lowered. With the latter, as temperature and/or time increase, the hardening precipitate, which was produced originally by differential temperature change, returns to solution in the metal matrix so as to lower electrical conductivity drastically. The present invention involves another technique, called stable dispersoid strengthening, which, as is well-known, involves a uniform distribution of very small particles throughout the metal matrix. These particles are "stable" in that they essentially are insoluble in both the solid and the molten metal and, hence, have only a limited tendency to reduce electrical conductivity by solid solution. But these particles are sufficiently small and numerous to block effectively the atomic rearrangements that constitute recovery and recrystallization. As a result, these particles maintain the desirable strain hardening of cold work or the like (desirable because of strengthening plus minimum effect on electrical conductivity) from room temperature to well above the recovery and recrystallization temperatures of the copper matrix. Stable dispersoid strengthening of the foregoing type can be achieved in various ways, including; fusion meallurgy by which the dispersoid particles are mixed into a matrix melt; powder metallurgy by which dispersoid particles and soft matrix particles are mixed and compacted; or by internal reaction involving precipitation of dispersoid particles in a matrix melt by chemical reaction. The present invention is based on the discovery of novel internal reaction techniques by which particles having an unusual combination of refractory properties and selected size can be maintained as a dispersion within a copper matrix during solidification.

SUMMARY OF THE INVENTION

The primary object of the present invention is the provision of processes and products involving the stable dispersoid strengthening of copper by minute refractory titanium carbide particles formed by internal reaction between particularly selected components including nickel in the copper matrix melt. These components are such that the nickel constitutes a bridging agent between the copper melt and the so-formed refractory particles, which are of such a nature that they would not remain in dispersion in the absence of this bridging agent. Although the interaction of these components is not understood with certainty, it is believed that following formation of the refractory particles and prior to solidification of the copper matrix, there are three phases, viz. liquid (e.g. molten copper), pseudo - liquid (e.g. bridging agent) and solid (e.g. refractory particles). As will be explained below, wettability can be indicated quantitatively in terms of wetting angle between phases that have, in effect, a liquid-solid or equivalent relationship. The arrangement here is such as to cause the components causes the bridging agent to act as an equivalent solid with a relatively low wetting angle with respect to the copper melt and as an equivalent liquid with a relativey low wetting angle with respect to the refractory compound, whereby a relatively high wetting angle (or contact angle) between the refractory compound and the melt is obviated. These refractory particles are characterized by melting temperatures that are very high and by thermodynamic relationships which enable their formation in situ within the copper melt. In particular, it has been shown that the wetting angle between such refractory compounds and molten metals, including copper, is dependent upon the principal direction of transport involved in any interaction between components of the contacting materials, i.e. the principal direction of transfer from a dissociating material to a forming material in the system. Certain of the processes described specifically herein as illustrating the present invention comprise the steps of adding to the melt a first component containing nickel having a low wetting angle with the melt, a second component containing titanium capable of reacting with carbon in the melt, and, as a third component, the aforementioned carbon for refractory particle formation.

Other objects of the present invention will in part be obvious and will in part appear hereinafter.

The invention accordingly comprises the processes and products involving the several steps and components and the relationships there among, which are exemplified in the following disclosure, the scope of which will be indicated in the appended claims.

BRIEF DESCRIPTION OF THE DRAWING

For a fuller understanding of the nature and objects of the present invention, reference should be had to the following detailed description taken in connection with the accompanying drawings, wherein.

DETAILED DESCRIPTION

Figure 1:
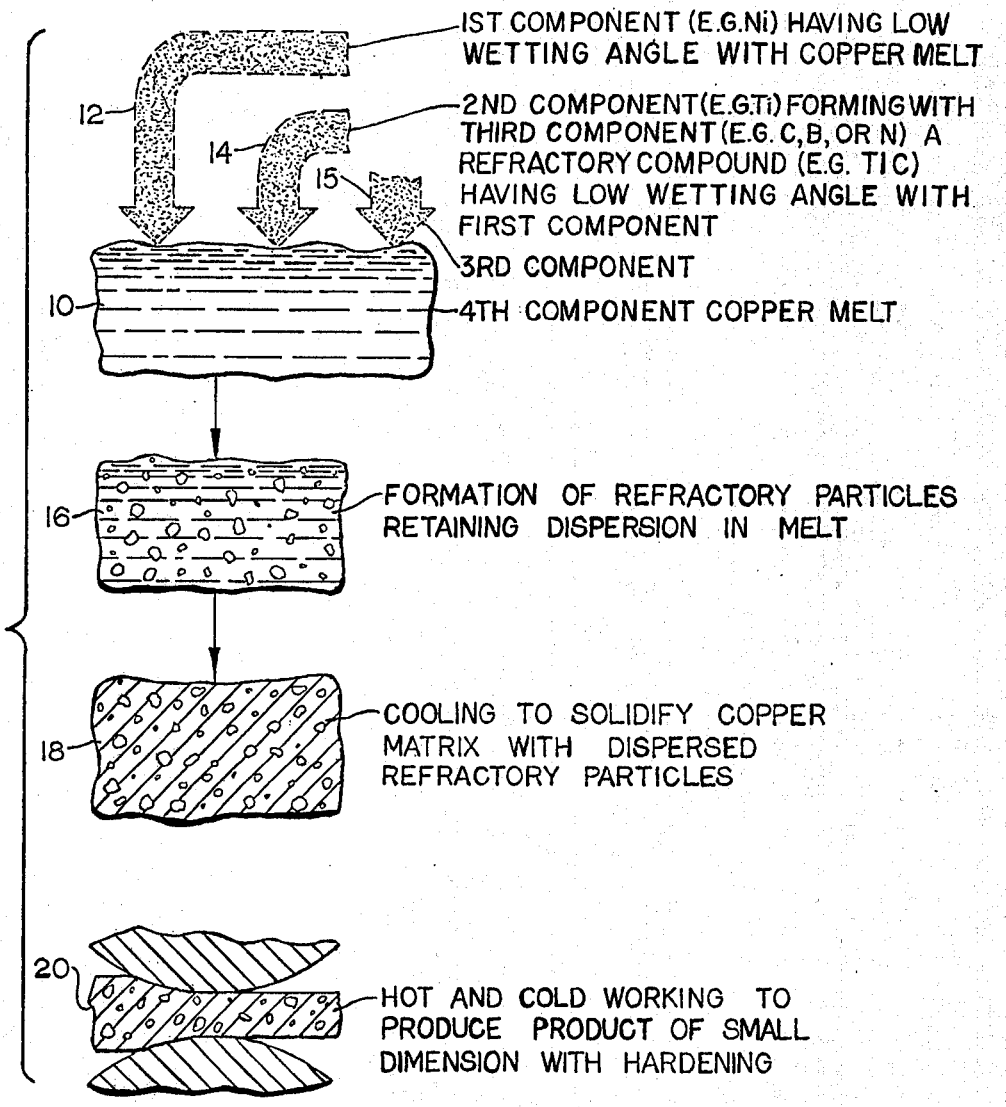
FIG. 1 is a flow diagram, illustrating in exaggerated cross-section, certain physical characteristics of a composition undergoing a process in accordance with the present invention.

The processes specifically described below comprise the steps of heating a copper base metal 10 to a temperature above its melting point to provide a melt, dissolving in the melt at least a first component 12 which is a metallic element having a low wetting angle with respect to the melt, adding at least a second component 14 and a third component 18 in order to form in situ particles 16 of a refractory compound having a low wetting angle with respect to the metal of the first component, cooling the composite material to a temperature below the melting point of the copper base metal in order to provide as at 18 a solid copper matrix and a uniform refractory compound dispersoid, and hot and cold working as at 20 the composite material to produce desired shape and strain hardening. In one form, two metals first are added as components and then a non-metal is added as a component, the system being such that one of the metals is soluble in the melt and the other of the metals forms with the non-metal the refractory compound, which has an affinity for the first mentioned metal. Preferably, based on total volume, the volume percent of the particles ranges between 0.1 and 10%. Preferably, particle diameters on the average are less than 2.0 microns. In accordance with the present invention, each of these perferences is achievable as desired because the formation of the particles in situ is the result of predetermined reaction conditions. Furthermore, because of the inherent stability of the composite reaction product, the reaction product economically can be hot worked into any desired shape, before being cold worked to final dimensions. Applicable concepts of wettability will be discussed now and specific classes of material will be discussed later.

Figure 2:
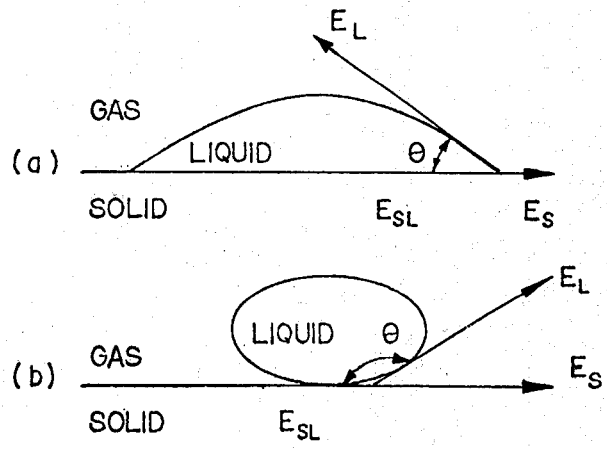
FIGS. 2(a) and (b) include diagrammatic representations of certain aspects of the concept of wetting angle of significance in connection with the present invention.

Stable dispersoid strengthening by fusion metallurgy, i.e. effectively distributing dispersoid particles in a molten matrix and maintaining the distribution as a stable system, requires that the particles be wetted in one way or another. As indicated above, in the present case there is a low wetting angle between the dispersoid particles and a bridging agent rather than between the dispersoid particles and the copper melt. In the absence of the bridging agent, the poorly-wetted or unwetted particles would tend to agglomerate in the melt before solidification could be effected. An explanation of "wetting" is found in the nature of the bonds that are possible between contacting components in a system. Such bonding generally is electrostatic, being the result variously of van der Waals forces, dipole forces, valence forces and co-valent forces. It is believed that wetting occurs between two unlike materials when the forces are stronger between them than are the forces between the atoms of one of the materials. In a system consisting of a liquid or equivalent phase and a solid or equivalent phase, the former will wet the latter to a degree dictated by the surface energies of the system. Such a system is illustrated in FIG. 2 where the surface energies of th system and the wetting angle are indicated. The fundamental relationship is:

$$E_S = E_{SL} + E_L \cos\theta$$

where:

$E_S$ = Surface energy of the solid
$E_L$ = Surface energy of the liquid
$E_{SL}$ = Solid-liquid Interface energy
$\theta$ = Wetting angle The foregoing relationship is a useful approximation. The work of adhesion, Wa, which is a measure of the bonding force between the liquid phase and the solid phase, is defined as:

$$Wa = E_S + E_L - E_{SL}$$

which may be written as:

$$Wa = E_L (1 + \cos\theta).$$

The bonding force between the two phases of the system now can be expressed in terms of the wetting angle and the surface tension of the liquid. As a practical matter, the wetting angle in any particular system can be measured directly on a photograph of the system. It is to be noted that: when $\theta = 90°$, $Wa = E_L$; and when $\theta = 180°$, $Wa = 0$. It is known that $\theta$ varies with the chemical composition of the liquid phase and with the chemical composition of the solid phase, and that $\theta$ decreases (and $Wa$ increases) with increasing temperature.

Figure 3:
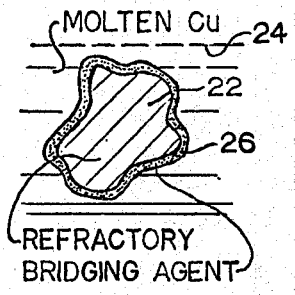
FIG. 3 is an exaggerated illustration of relationships among a matrix, a bridging agent and a particle in accordance with the present invention.

FIG. 3 illustrates an atomistic model of the components of a typical system produced as in FIG. 1 and involving relationships of the type shown in FIG. 2. Here, a refractory particle 22, for example TiC, is formed in situ within a copper melt 24 by mixing a first starting copper melt containing a first dissolved component, in the form of titanium, and a second starting copper melt containing a second dissolved component, in the form of nickel, and by adding carbon to the composite melt in order to produce the refractory particle. In this example Ni atoms are attracted more strongly to the TiC refractory particle than are the Cu atoms, i.e. Ni wets TiC better than does Cu. So the Ni atoms displace Cu atoms on the TiC refractory particle surface at least one and perhaps several Ni atoms deep. This attraction of the TiC refractory particle for the Ni atoms holds the Ni atoms in order array — more ordered than in molten Ni but less ordered than in solid Ni, i.e. as a pseudo-liquid-crystal phase. This phase has an interface with the molten Cu. Since Ni and Cu normally dissolve in each other completely (which, if it occurred, would remove almost completely the Ni coating from the TiC), the molten Cu perfectly wets the pseudo-liquid-crystal Ni coating but does not dissolve it. Thus the Ni functions as a "bridging agent," i.e. it wets the TiC particle on its interior interface and the molten Cu matrix on its exterior interface (but without dissolving in the Cu which would both dissipate the bridging agent and decrease the conductivity of Cu).

In the specific examples hereinbelow, the matrix contains at least 50% copper so that copper is at least one of its characteristic ingredients. In the specific examples hereinbelow, the following three types of copper matrix are utilized, it being understood that the following formulations merely are illustrative but not restrictive. (1) Electrolytic tough Pitch (ETP) copper, which contains, by total weight in a remainder of copper: combined oxygen in the form of $Cu_2O$ and dissolved oxygen — 0.04%: and nickel, iron, bismuth and arsenic — trace. (2) Lake copper, which contains, by total weight in a remainder of copper: from 0.04 to 0.089% silver, in addition to the minor proportions of oxygen, nickel, iron, bismuth, and arsenic, as specified above in connection with ETP copper. (3) Oxygen-free (OF) copper, typically containing by total weight in addition to a remainder of copper approximately: iron — 0.0005%; sulfur — 0.0025%; silver — 0.001%; nickel — 0.006%; tin — 0.002%; arsenic — 0.0003%; selenium — 0.0002%; tellurium — 0.0001%; lead — 0.0006%; antimony — 0.0002%; manganese — 0.0005%; bismuth — 0.0001%; and oxygen — 0.0002%. When electrical conductivity is not a primary consideration, the matrix in various forms is composed of an alloy of copper.

The illustrated titanium carbine refractory particles are formed in situ in the presence of the nickel bridging agent which has low contact angles with respect to both the molten copper matrix and the titanium carbide refractory particles. Generally such titanium carbide refractory particles are characterized by high chemical stability and melting points of at least 3000° C. It has been known that the interactions of the foregoing materials at molten metal temperatures involve migration between two such materials in one direction or the other and that wettability of refractory compounds by metals is a function of the character of their chemical interaction. This chemical interaction depends upon electronic and crystalline structure. Thus, metals with filled d-electron shells (non-transition metals) wet carbides poorly and metals with unfilled d-electron shells actively interact with carbides and wet their surfaces. The wettability of carbides by metals is improved with a decrease of the ability of the carbide forming titanium to accept electrons.

The direction of the principal migration of atoms, which depends upon the character of the chemical interaction of the materials in contact, has been known to exert an effect on the value of the wetting angle between these materials. In accordance with the present invention, a variety of refractory compounds may be produced in situ within a copper melt from components that are selected on the basis of such principal migration direction. In the present case the surface of the refractory titanium carbide is not wetted by the molten copper and the contact angle is greater than 90°, specifically is equal to 127°.

EXAMPLES

The following non-limiting examples will further illustrate the principles of the present invention.

EXAMPLE 1

One hundred parts by weight of OF copper was heated to the molten state at 1200° C., one half of the copper being placed in a first crucible and the other half of the copper being placed in a second cricible. 2.2 parts by weight of nickel was dissolved in the copper of the first crucible and 0.88 parts by weight of titanium was dissolved in the copper of the second crucible, both nickel and titanium being completely soluble in molten copper. Then the copper-nickel melt was saturated with carbon by addition of carbon black. Finally the copper-nickel-carbon melt was poured into the copper-titanium melt. When the copper-nickel-carbon melt was poured into the copper-titanium melt, the resulting mixture became very slushy and the temperature of the melt had to be raised to 2450° F. to facilitate pouring for casting. After casting, the alloy was studied metallographically. The resulting alloy then was hot-rolled at 1800° F. and cold-rolled 69%. Finally, samples were annealed at several temperatures for one hour and air-cooled. After annealing, the hardness and conductivity were measured. The hardness and conductivity of the resulting melt as a function of annealing temperature are shown in the following table:

| Temperature ° F | Hardness Rockwell B | Conductivity %I.A.C.S. |
|---|---|---|
| RT | 92 | 31 |
| 800 | | 39 |
| 1000 | 94 | 55 |
| 1200 | 80 | 50 |
| 1400 | 58 | 41 |
| 1600 | 44 | 31 |
| 1800 | 44 | 36 |

The above readings of conductivity and hardness were taken at room temperature after air cooling from the annealing temperature. It will be observed that in the foregoing product, reasonably good conductivity is coupled with unusually high strength at elevated temperatures.

EXAMPLE 2

One hundred parts by weight of OF copper were melted in a crucible. Then, in order, there were added to the melt 1.1 parts by weight of nickel, 0.66 parts by weight of titanium and the melt was saturated with carbon. The melt was solidified, hot rolled from 1 inch to 0.250 inch and cold rolled from 0.250 inch to 0.100 inch. Hardness and conductivity as a function of annealing temperature are shown in the following table.

| Temperature ° F | Hardness Rockwell B F | Conductivity %I.A.C.S. |
|---|---|---|
| RT | 83 | 31 |
| 800 | 83 | 46 |
| 1000 | 83 | 52 |
| 1200 | 79 | 46 |
| 1400 | 69 | 45 |
| 1600 | 64 | 49 |
| 1800 | 60 | 47 |

EXAMPLE 3

The process of Example 2 was repeated except that the weight of nickel was 0.55 parts, the weight of titanium was 0.44 parts and the carbon was replaced by 0.15 parts by weight of boron. The hardness and conductivity of the resulting melt as a function of annealing temperature are shown in the following table.

| Temperature ° F | Hardness Rockwell B | F | Conductivity %I.A.C.S. |
|---|---|---|---|
| RT | 68 | | 64 |
| 800 | | 59 | 68 |
| 1000 | | 55 | 68 |
| 1200 | | 52 | 69 |
| 1400 | | 48 | 68 |
| 1600 | | 42 | 69 |
| 1800 | | 29 | 71 |

In accordance with the present invention, preferred results have been obtained with a copper matrix and refractory dispersion system in which the components include copper, nickel, titanium and carbon. In connection with this specific system, the results listed in the first column below have been obtained and, in an attempt to communicate the teachings of the invention more clearly, a possible explanation in terms of the hypothesized model illustrated in FIG. 3 is given in the right-hand column:

| Experimental Finding | Possible Explanation |
|---|---|
| A. Changing the nickel content, by approximate total weight, from .55% to 1.1% does not change the hardness appreciably. | A. The Ni atoms preferentially wet and coat the TiC surface; adding additional Ni simply increases the thickness of the Ni coating so there is no effect on hardness. |
| B. Omitting the nickel causes the hardness to drop considerably. | B. With no Ni to act as a bridging agent, the TiC particles agglomerate and are less effective hardeners. |
| C. Changing the titanium content, by approximate total weight, from .44% to .66% causes the hardness to increase in both the aged and overaged condition and extends the softening point to a higher temperature. | C. The higher Ti results in more TiC particles which gives higher hardness. |
| D. Changing the nickel content, by approximate total weight from .55% to 1.1% does not appreciably affect conductivity. | D. As noted in "A" above, most of the Ni atoms coat the TiC particles so relatively little Ni is in solid solution in the Cu so the conductivity of the latter is not lowered by a Ni increment. |

From an inspection of the foregoing results and of FIG. 3, it can be appreciated that, in practice, it is not always feasible to have all the Ti reacted to form TiC, nor is it always feasible to have all the Ni adsorbed on the TiC surfaces. Such extra Ti and Ni may, with copper, impart precipitation-hardening properties to the alloy. This is in addition to the stable dispersoid strengthening effected by the TiC particles coated with Ni bridging agent. Thus the alloys of this invention can usefully combine both precipitation hardening and dispersoid strengthening.

The present invention thus provides a novel dispersoid strengthened copper base metal in which wetting relationships among the copper, a binding agent and a refractory compound serve to control the dispersion both in the melt and during solidification. Since certain changes may be made in the above disclosure without departing from the scope of the invention hereof, it is intended that all matter described in the foregoing specification and shown in the accompanying drawing be interpreted in an illustrative and not in a limiting sense.

What is claimed is:

1. A process for producing a dispersoid strengthened copper composition, said process comprising the steps of heating a copper base matrix to a temperature above its melting point to form a melt, said copper base matrix consisting essentially of copper, dissolving in said melt a bridging metal consisting essentially of nickel, dispersing titanium as as a refractory component metal in said melt, dispersing carbon in said melt to produce in situ within said melt a refractory titanium carbide dispersoid by reaction between said refractory dispersoid titanium metal and said refractory dispersoid carbon non-metal, said titanium carbide refractory dispersoid having a low wetting angle with respect to said nickel bridging metal and a high wetting angle with respect to said matrix, said titanium carbide refractory dispersoid having a melting point of at least 3000° C., cooling said melt to a temperature below its melting point, and working said copper composition in order to reduce at least one of its geometrical dimensions, said titanium carbide refractory dispersoid ranging in total volume from 0.1 to 10%, said copper being present in sufficient concentration to impart an I.A.C.S. of at least 31% at temperatures ranging from room temperature to 1800° F.

2. A process for producing a dispersoid strengthened copper composition, said process comprising the steps of heating a copper base matrix to a temperature above its melting point to form a melt, dissolving in said melt a bridging metal composed of nickel, dispersing a refractory component metal in said melt, dispersing a refractory component non-metal in said melt to produce in situ within said melt a refractory dispersoid by reaction between said refractory dispersoid metal and said refractory dispersoid non-metal, said refractory dispersoid having a low wetting angle with respect to said bridging metal and a high wetting angle with respect to said matrix, said refractory dispersoid being titanium carbide and having a melting point of at least 3000° C., cooling said melt to a temperature below its melting point, and working said copper composition in order to reduce at least one of its geometrical dimensions, said refractory dispersoid ranging in total volume from 0.1 to 10%, the particle diameters of said dispersoid on the average being less than 2 microns, by total weight said nickel being approximately 1.1 parts, said titanium being approximately 0.66 parts and said carbon approximately saturating said melt, said copper being present in sufficient concentration to impart an I.A.C.S of at least 31% temperatures ranging from room temperature to 1800° F.

3. A metallurgical product having a dispersoid strengthened copper composition, said product consisting essentially of a copper base matrix and a dispersion of refractory particles, said copper base matrix consisting essentially of copper, a bridging metal at the interfaces between said copper base matrix and said dispersion, said bridging metal consisting essentially of nickel, said refractory particles having a low wetting angle with respect to said bridging metal and a high wetting angle with respect to said matrix, said refractory particles consisting essentially of titanium carbide, said copper being present in sufficient concentration to impart an I.A.C.S. of at least 31% at temperature ranging from room temperature to 1800° F., said refractory particles ranging in total volume from 0.1 to 10%.

4. A metallurgical product having a dispersoid strengthening copper composition, said product consisting essentially of a copper base matrix and a dispersion of refractory particles, a bridging metal at the interfaces between said copper base matrix and said dispersion, said bridging metal being essentially nickel, said refractory particles having a low wetting angle with respect to said bridging metal and a high wetting angle with respect to said matrix, said refractory dispersoid being a compound of a refractory dispersoid metal and a refractory dispersoid non-metal, said refractory dispersoid being essentially titanium carbide and having a melting point of at least 3,000° C., said refractory dispersoid ranging in total volume from 0.1 to 10%, the particle diamters of said dispersoid on the average being less than 2 microns, by total weight, said nickel being approximately 1.1 parts, said titanium being approximately 0.66 parts and said carbon approximately saturating said melt, said copper being present in sufficient concentration to impart an I.A.C.S. of at least 31% at temperature ranging from room temperature to 1800° F.

5. The dispersoid strengthened copper composition of claim 3 wherein said dispersoid consists of particles having an average diameter less than 2 microns.

6. The dispersoid strengthened copper composition of claim 3 wherein said nickel is present by total weight of said composition from 0.55 to 1.1 percent.

* * * * *